US009518243B2

(12) United States Patent
Antzutkin et al.

(10) Patent No.: US 9,518,243 B2
(45) Date of Patent: Dec. 13, 2016

(54) IONIC-LIQUID-BASED LUBRICANTS AND LUBRICATION ADDITIVES COMPRISING IONS

(76) Inventors: Oleg N. Antzutkin, Luleå (SE); Faiz Ullah Shah, Luleå (SE); Sergei Glavatskikh, Luleå (SE)

( * ) Notice: Subject to any disclaimer, the term of this patent is extended or adjusted under 35 U.S.C. 154(b) by 543 days.

(21) Appl. No.: 14/006,115

(22) PCT Filed: Mar. 22, 2012

(86) PCT No.: PCT/SE2012/050317
§ 371 (c)(1),
(2), (4) Date: Sep. 19, 2013

(87) PCT Pub. No.: WO2012/128714
PCT Pub. Date: Sep. 27, 2012

(65) Prior Publication Data

US 2014/0011720 A1 Jan. 9, 2014

(30) Foreign Application Priority Data

Mar. 22, 2011 (SE) ..... 1150255

(51) Int. Cl.

| | |
|---|---|
| ***C10M 139/00*** | (2006.01) |
| ***C10M 137/10*** | (2006.01) |
| ***C10M 133/08*** | (2006.01) |
| ***C10M 141/12*** | (2006.01) |
| ***C10M 105/78*** | (2006.01) |

(52) U.S. Cl.
CPC ..... *C10M 141/12* (2013.01); *C10M 105/78* (2013.01); *C10M 139/00* (2013.01);
(Continued)

(58) Field of Classification Search
CPC ..... C10M 2227/061; C10M 2227/062; C10M 2207/027
(Continued)

(56) References Cited

U.S. PATENT DOCUMENTS

| | | | |
|---|---|---|---|
| 3,239,463 | A | 3/1966 | Knowles et al. |
| 7,754,662 | B2 | 7/2010 | Aswath et al. |

(Continued)

FOREIGN PATENT DOCUMENTS

| | | | |
|---|---|---|---|
| WO | WO-2009/121494 | A1 | 10/2009 |
| WO | WO-2010/086131 | A1 | 8/2010 |
| WO | WO-2010/096167 | A1 | 8/2010 |

OTHER PUBLICATIONS

International Search Report for PCT/SE2012/050317, mailed Jul. 10, 2012; ISA/SE.

*Primary Examiner* — Vishal Vasisth

(74) *Attorney, Agent, or Firm* — Harness, Dickey & Pierce, PLC

(57) ABSTRACT

Anti-wear and friction-reducing lubricants and additives to lubricants for both ferrous and non-ferrous materials with/without DLC (diamond-like-coatings) or graphene-based coatings, which are halogen free boron based ionic liquids comprising a combination of an anion chosen from a mandelato borate anion, a salicylato borate anion, an oxalato borate anion, a malonato borate anion, a succinato borate anion, a glutarato borate anion and an adipato borate anion, with at least one cation selected from a tetraalkylphosphonium cation, a choline cation, an imidazolium cation and a pyrrolidinium cation, wherein said at least one cation has at least one alkyl group substituent with the general formula $C_nH_{2n+1}$, wherein $1 \leq n \leq 80$. Advantages of the invention include that it provides halogen free ionic liquids for lubrication and that sensitivity for hydrolysis is reduced.

17 Claims, 7 Drawing Sheets

(52) U.S. Cl.
CPC ... *C10M 2215/02* (2013.01); *C10M 2215/023* (2013.01); *C10M 2215/2203* (2013.01); *C10M 2215/223* (2013.01); *C10M 2215/224* (2013.01); *C10M 2215/2245* (2013.01); *C10M 2223/06* (2013.01); *C10M 2223/0603* (2013.01); *C10M 2227/061* (2013.01); *C10M 2227/062* (2013.01); *C10M 2227/0615* (2013.01); *C10M 2227/0625* (2013.01); *C10N 2220/04* (2013.01); *C10N 2230/06* (2013.01); *C10N 2230/66* (2013.01)

(58) Field of Classification Search
USPC ..... 508/198, 423, 500
See application file for complete search history.

(56) References Cited

U.S. PATENT DOCUMENTS

2008/0045723 A1 2/2008 Cassol et al.
2009/0029887 A1* 1/2009 Schwab ..... B21D 22/201 508/283
2009/0163394 A1 6/2009 Muraishi et al.
2009/0170734 A1* 7/2009 Schwab ..... C07D 233/06 508/283
2010/0029519 A1* 2/2010 Schwab ..... C10M 169/04 508/208
2010/0105586 A1 4/2010 Bodesheim et al.
2010/0120640 A1* 5/2010 Schwab ..... C10M 133/44 508/423
2010/0187481 A1 7/2010 Bodesheim et al.
2010/0227783 A1 9/2010 Habeeb et al.
2011/0092399 A1 4/2011 Schmidt-Amelunxen et al.
2012/0021957 A1* 1/2012 Alemany ..... C09K 5/00 508/283
2012/0157360 A1* 6/2012 Massonne ..... C09K 5/047 508/283

* cited by examiner

IONIC-LIQUID-BASED LUBRICANTS AND LUBRICATION ADDITIVES COMPRISING IONS

CROSS-REFERENCE TO RELATED APPLICATIONS

This application is a 371 U.S. National Stage of International Application No. PCT/SE2012/050317, filed Mar. 22, 2012, and claims priority to Swedish Patent Application No. 1150255-6, filed Mar. 22, 2011, the disclosures of which are herein incorporated by reference in their entirety.

TECHNICAL FIELD

The present invention relates to anti-wear and friction-reducing lubricant components comprising selected ionic liquids as well as a lubricant comprising the lubricant component.

BACKGROUND

Improper lubrication may result in high friction and wear losses, which can in turn adversely affect the fuel economy, durability of engines, environment and human health. Developing new technological solutions, such as use of lightweight non-ferrous materials, less harmful fuels, controlled fuel combustion processes or more efficient exhaust gas after-treatment, are possible ways to reduce the economical and environmental impact of machines. The commercially available lubricants are yet not appropriate for lightweight non-ferrous materials.

Ionic liquids (ILs) are purely ionic, salt-like materials that are usually liquid at low temperatures (below 100° C.). Some IL have melting points below 0° C. ILs have already found their diverse applications as catalysts, liquid crystals, green solvents in organic synthesis, in separation of metal ions, electrochemistry, photochemistry, $CO_2$ storage devices, etc. ILs have a number of attractive properties, such as negligible volatility, negligible flammability, high thermal and chemical stability, low melting point and controllable miscibility with organic compounds and base oils. Recently, it was found that ILs can act as versatile lubricants and lubricant components in base oils and greases for different sliding pairs, see e.g. U.S. Pat. No. 3,239,463; US Patent Application Publication 2010/0227783 A1; US Patent Application Publication 2010/0187481 A1; U.S. Pat. No. 7,754,664 B2, Jul. 13, 2010; US Patent Application Publication 2010/0105586 A1. Due to their molecular structure and charges, ILs can be readily adsorbed on the sliding surfaces in frictional pairs, forming a boundary tribofilm, which reduces both friction and wear at low and high loads.

The choice of cations has an impact on properties of ILs and often, but not always defines their stability. Functionality of ILs is, in general, controlled by a choice of both the cation and the anion. Different combinations of a broad variety of already known cations and anions lead to a theoretically possible number of $10^{18}$. Today only about 1000 ILs are described in the literature, and approximately 300 of them are commercially available. ILs with cations imidazolium, ammonium and phosphonium and halogen-containing anions, tetrafluoroborates and hexafluorophosphates, are the most commonly used in tribological studies. Alkylimidazolium tetrafluoroborates and hexafluorophosphates have shown promising lubricating properties as base oils for a variety of contacts. However, some ILs with halogen atoms in their structure, for example, with tetrafluoroborates or/and hexafluorophosphates, are very reactive that may increase a risk for tribocorrosion in ferrous and non-ferrous contacts.

Imidazolium and Other ILs with $BF_4$ Anion:

A literature survey shows that most of the IL lubricants successfully employed during the past decade in various ferrous and non-ferrous tribological contacts are based on boron-based anion, tetrafluoroborate $[BF_4]^-$[Ye, C., Liu, W., Chen, Y., Yu, L.: Room-temperature ionic liquids: a novel versatile lubricant. Chem. Commun. 2244-2245 (2001). Liu, W., Ye, C., Gong, Q., Wang, H., Wang, P.: Tribological performance of room-temperature ionic liquids as lubricant. *Tribol. Lett.* 13 (2002) 81-85. Chen, Y. X., Ye, C. F., Wang, H. Z., Liu, W. M.: Tribological performance of an ionic liquid as a lubricant for steel/aluminium contacts. *J. Synth. Lubri.* 20 (2003) 217-225. Jimenez, A. E., Bermudez, M. D., Iglesias, P., Carrion, F. J., Martinez-Nicolas, G.: 1-N-alkyl-3-methylimidazolium ionic liquids as neat lubricants and lubricant components in steel aluminum contacts. *Wear* 260 (2006) 766-782. Yu, G., Zhou, F., Liu, W., Liang, Y., Yan, S.: Preparation of functional ionic liquids and tribological investigation of their ultra-thin films. *Wear* 260 (2006) 1076-1080.]

Zhang et al. have reported that nitrile-functionalized ILs with $BF_4^-$ anion have considerably better tribological performance in steel-steel and steel-aluminium contacts than ILs with $NTf_2^-$ and $N(CN)_2^-$ anions [Q. Zhang, Z. Li, J. Zhang, S. Zhang, L. Zhu, J. Yang, X. Zhang, Y. J. Deng. Physicochemical properties of nitrile-functionalized ionic liquids. J. Phys. Chem. B, 2007, 111, 2864-2872.] It has been suggested that the BF anion has excellent tribological performance but unfortunately the detailed mechanism was not described.

A comparison of the film formation properties of imidazolium ILs based on $BF_4^-$ and $PF_6^-$ anions in rolling-sliding steel-steel contacts using mini-traction machine (MTM) revealed that $BF_4^-$ anion develop thicker tribofilm and provides lower friction ($\mu$=0.01) compared to $PF_6^-$ ($\mu$=0.03) [H. Arora, P. M. Cann. Lubricant film formation properties of alkyl imidazolium tetrafluoroborate and hexafluorophosphate ionic liquids. *Tribol. Int.* 43 (2010) 1908-1916.] The same family of ILs in titanium-steel contacts has shown that $BF_4$ anion-based IL fails above room temperature while $PF_6$— anion-based IL perform better up to 200° C. [A. E. Jimenez, M. D. Bermudez. Ionic liquids as lubricants of titanium-steel contact. part 2: friction, wear and surface interactions at high temperature. *Tribol. Lett.* 37 (2010) 431-443.] In steel-aluminium contacts, phosphonium IL with $BF_4^-$ anion showed superior tribological properties including friction-reducing, antiwear and load carrying capacity to conventional imidazolium IL based on $PF_6^-$ anion [X. Liu, F. Zhou, Y. Liang, W. Liu. Tribological performance of phosphonium based ionic liquids for an aluminum-on-steel system and opinions on lubrication mechanism. *Wear* 261 (2006) 1174-1179.] Similarly, phosphonium IL with $BF_4^-$ anion exhibited excellent tribological performance at 20° C. and 100° C. in steel-steel contacts as compared to imidazolium-$PF_6^-$ and conventional high temperature lubricants such as X-1P and perfluoropolyether PFPE [L. Wenga, X. Liu, Y. Liang, Q. Xue. Effect of tetraalkylphosphonium based ionic liquids as lubricants on the tribological performance of a steel-on-steel system. *Tribol. Lett.* 26 (2007) 11-17.]

However, the sensitivity of $[BF_4]^-$ anion to moisture make such ILs undesirable in tribological and other industrial applications. During the past few years, efforts have been made by researchers to design and synthesize hydrolytically stable halogen-free boron-based ILs with improved performance.

Pyrrolidinium ILs with Halogenated Anions:

The lubricating properties of pyrrolidinium ILs with $[BF_4]^-$ anion are not reported yet. However, pyrrolidinium IL with other halogenated anions are reported in literature as excellent lubricants and lubricant components for various tribological applications. Recently, pyrrolidinium ILs with halogenated anions have shown excellent lubrication performance in microelectromechanical systems (MEMS) [J. J. Nainaparampil, K. C. Eapen, J. H. Sanders, A. A. Voevodin. Ionic-Liquid Lubrication of Sliding MEMS Contacts: Comparison of AFM Liquid Cell and Device-Level Tests. *J. Microelectromechanical Systems* 16 (2007) 836-843.]

1-Butyl-1-methylpyrrolidinium tris(pentafluoroethyl)trifluorophosphate, as is known to possess promising lubricating properties in non-ferrous coatings interfaces such as TiN, CrN and DLC [R. Gonzalez, A. H. Battez, D. Blanco, J. L. Viesca, A. Fernandez-Gonzalez. Lubrication of TiN, CrN and DLC PVD coatings with 1-Butyl-1-Methylpyrrolidinium tris(pentafluoroethyl)trifluorophosphate. *Tribol. Lett.* 40 (2010) 269-277.]

Cholinium ILs with Halogenated Anions:

Choline is biological molecule in the form of phosphatidylcholine (liposome), a major constituent of synovial fluid surface active phospholipids, are natural additives for cartilage lubricants in human beings [G. Verberne, A. Schroeder, G. Halperin, Y. Barenholz, I. Etsion, Liposomes as potential biolubricant components for wear reduction in human synovial joints. *Wear* 268 (2010) 1037-1042.] These molecules are widely used in effective biolubricants for friction and wear reduction in human synovial joints [S. Sivan, A. Schroeder, G. Verberne, Y. Merkher, D. Diminsky, A. Priev, A. Maroudas, G. Halperin, D. Nitzan, I. Etsion, Y. Barenholz. Liposomes act as effective biolubricants for friction reduction in human synovial joints. *Langmuir* 26 (2010) 1107-1116.]

Cholinium ILs, choline chloride, has recently shown excellent friction reducing performance in steel-steel contacts comparable to fully formulated engine oil (SAE 5W30 grade) [S. D. A. Lawes, S. V. Hainsworth, P. Blake, K. S. Ryder, A. P. Abbott. Lubrication of steel/steel contacts by choline chloride ionic liquids. *Tribol. Lett.* 37 (2010) 103-110.] These ILs are believed as green lubricants and have been known to have excellent corrosion inhibition properties [C. Gabler, C. Tomastik, J. Brenner, L. Pisarova, N. Doerr, G. Allmaier. Corrosion properties of ammonium based ionic liquids evaluated by SEM-EDX, XPS and ICP-OES. *Green Chem.* 13 (2011) 2869-2877.]

US 2009/0163394 discloses a number of ionic liquids, for instance Methyl-n-butylbis(diethylamino)-phosphonium bis(oxalato)borate. It briefly mentions that lubrication oils as a general application for ionic liquids. One drawback of the compounds that are disclosed is that the direct P—N bonds in cations of described phosphonium based ionic liquids are sensitive to hydrolysis, which is critical in many important applications including most of commercial lubricants with unavoidable presence of traces of water. Compounds with P—N bonds are very sensitive to hydrolysis and may hydrolyze to produce reactive species. Therefore, phosphonium cations with one and more P—N chemical bonds will be prone to hydrolysis in the presence of traces of water in a lubricant. Stability of a lubricant placed in a contact with water is a very important technical characteristics.

The most widely studied ionic liquids in tribological applications usually contain tetrafluoroborate ($BF_4^-$) and hexafluorophosphate ($PF_6^-$) anions. Probably, the reason is that both boron and phosphorus atoms have excellent tribological properties under high pressure and elevated temperature in the interfaces. However, $BF_4^-$ and $PF_6^-$ anions have high polarity and absorb water in the system. These anions are very sensitive to moisture and may hydrolyze to produce hydrogen fluoride among other products. These products cause corrosion by various tribochemical reactions, which can damage the substrate in the mechanical system. In addition, halogen-containing ILs may release toxic and corrosive hydrogen halides to the surrounding environment.

One major drawback of ionic liquids, which are known for lubrication purpose is that the halogens make them undesired for instance from an environmental perspective. Further corrosion may be a problem for some currently used ionic liquids in particular for hydrophilic ionic liquids.

Therefore, the development of new hydrophobic and halogen-free anions containing ILs is highly desired.

SUMMARY OF THE INVENTION

It is an object of the present invention to obviate at least some of the disadvantages in the prior art and provide an improved lubricant component as well as a lubricant comprising the component.

In a first aspect there is provided a lubricant component characterized in that it comprises: a) at least one anion selected from the group consisting of a mandelato borate anion, a salicylato borate anion, an oxalato borate anion, a malonato borate anion, a succinato borate anion, a glutarato borate anion and an adipato borate anion, and b) at least one cation selected from the group consisting of a tetraalkylphosphonium cation, a choline cation, an imidazolium cation, a borronium cation and a pyrrolidinium cation, wherein said at least one cation has at least one alkyl group substituent with the general formula $C_nH_{2n+1}$, wherein $1 \leq n \leq 80$.

In one embodiment $1 \leq n \leq 60$.

In one embodiment the anion is selected from the group consisting of a bis(mandelato)borate anion, a bis(salicylato) borate anion, and a bis(malonato)borate anion, and wherein the cation is a tetraalkylphosphonium cation.

In one embodiment the anion is bis(oxalato)borate and wherein the cation is a tetraalkylphosphonium cation.

In one embodiment the anion is a bis(succinato)borate anion and wherein the cation is a tetraalkylphosphonium cation.

In one embodiment the anion is selected from the group consisting of a bis(glutarato)borate anion and a bis(adipato) borate anion and wherein the cation is a tetraalkylphosphonium cation.

In one embodiment the only cation is tetraalkylphosphonium with the general formula $PR'R_3^+$, wherein R' and R are $C_nH_{2n+1}$.

In one embodiment R' is selected from the group consisting of $C_8H_{17}$ and $C_{14}H_{29}$, and wherein R is selected from the group consisting of $C_4H_9$ and $C_6H_{13}$.

In one embodiment the lubricant component comprises at least one selected from the group consisting of tributyloctylphosphonium bis(mandelato)borate; tributyltetradecylphosphonium bis(mandelato)borate; trihexyltetradecylphosphonium bis(mandelato)borate, tributyloctylphosphonium bis(salicylato)borate, tributyltetradecylphosphonium bis(salicylato)borate, trihexyltetradecylphosphonium bis(salicylato)borate, tributyltetradecylphosphonium bis(oxalato)borate, trihexyltetradecylphosphonium bis(oxalato)borate, tributyltetradecylphosphonium bis(malonato)borate, trihexyltetradecylphosphonium bis(malonato)borate, tributyltetradecylphosphonium bis(succinato)borate, trihexyltetradecylphosphonium bis(succinato)borate, tributyltetradecylphosphonium bis(glutarato)borate, trihexyltetradecylphosphonium bis(glutarato)borate, tributyltetradecylphosphonium bis(adipato)borate, trihexyltetradecylphosphonium bis(adipato)borate, choline bis(salicylato)borate, N-ethyl-N-methylpyrrolidinium bis(salicylato)borate, N-ethyl-N-methylpyrrolidinium bis(mandelato)borate, 1-ethyl-2,3-dimethylimidazolium bis(mandelato)borate, 1-ethyl-2,3-dimethylimidazolium bis(salicylato)borate, 1-methylimidazole-trimethylamine-$BH_2$ bis(mandelato)borate, 1,2-dimethylimidazole-trimethylamine-$BH_2$bis(mandelato)borate, 1-methylimidazole-trimethylamine-$BH_2$ bis(salicylato)borate, and 1,2-dimethylimidazole-trimethylamine-$BH_2$bis(salicylato)borate.

In one embodiment the lubricant component comprises trihexyltetradecylphosphonium bis(mandelato)borate.

In one embodiment the lubricant component comprises trihexyltetradecylphosphonium bis(salicylato)borate In one embodiment the lubricant component comprises trihexyltetradecylphosphonium bis(oxalato)borate.

In one embodiment the lubricant component comprises trihexyltetradecylphosphonium bis(malonato)borate.

In a second aspect there is provided a lubricant comprising 0.05-100 wt % of the lubricant component described herein. The lubricant component can both be used in pure form and as an additive to other lubricants. If the lubricant component is used in pure form the lubricant component itself is the sole lubricant.

In one embodiment the lubricant comprises 0.05-20 wt %, of the lubricant component as described herein. In one embodiment the lubricant comprises 0.1-5 wt %, of the lubricant component. In one embodiment the lubricant comprises 0.5-5 wt %, of the lubricant component.

In a third aspect there is provided use of the lubricant component as described herein for at least one selected from reducing wear and reducing friction.

In a fourth aspect there is provided a method for reducing friction comprising use of a lubricant with the lubricant component as described herein.

There is also provided a method for reducing wear comprising use of a lubricant with the lubricant component as described herein.

Advantages of the invention include that the replacement of $BF_4^-$, $PF_6^-$ and halogen containing ions with more hydrophobic and halogen-free anions will avoid corrosion and toxicity.

Halogen-free boron based ionic liquids, (=hf-BILs) with these novel halogen-free boron-based anions make a lubricant hydrolytically stable. This will aid to avoid the formation of hydrofluoric acid (HF) in the lubricant in the course of exploitation of machines. HF is produced by the most commonly used anion ($BF_4^-$) and ($PF_6^-$) in ILs. The formation of HF from ionic liquids is one of the main limitations of such lubricants, because HF is highly corrosive towards metals. The present novel hf-BILs according to the invention do not have such limitations.

Based on tribological studies of ionic liquids with imidazolium, pyrrolidinium and cholinium (as cations) and halogen-based anions, we suggest that ionic liquids according to the invention, i.e. ionic liquids with tetraalkylphosphonium, imidazolium, pyrrolidinium and cholinium (as cations) and halogen-free orthoborate anions will have good tribological performance in addition to their advantage as being halogen-free. Some examples of these halogen-free orthoborate anions are bis(mandelato)borate, bis(salicylato)borate, bis(oxalato)borate, bis(malonato)borate, bis(succinato)borate, bis(glutarato)borate and bis(adipato)borate. An outstanding antiwear and friction-reducing effect for steel-aluminium contacts has been proven for orthoborate based tetraalkylphosphonium ionic liquids and the "key" role is orthoborate anions in ILs as lubricants regarding these technical effects.

SHORT DESCRIPTION OF DRAWINGS

The invention will be described more in detail below with reference to the accompanying drawings, in which.

DETAILED DESCRIPTION OF THE INVENTION

Figure 1:
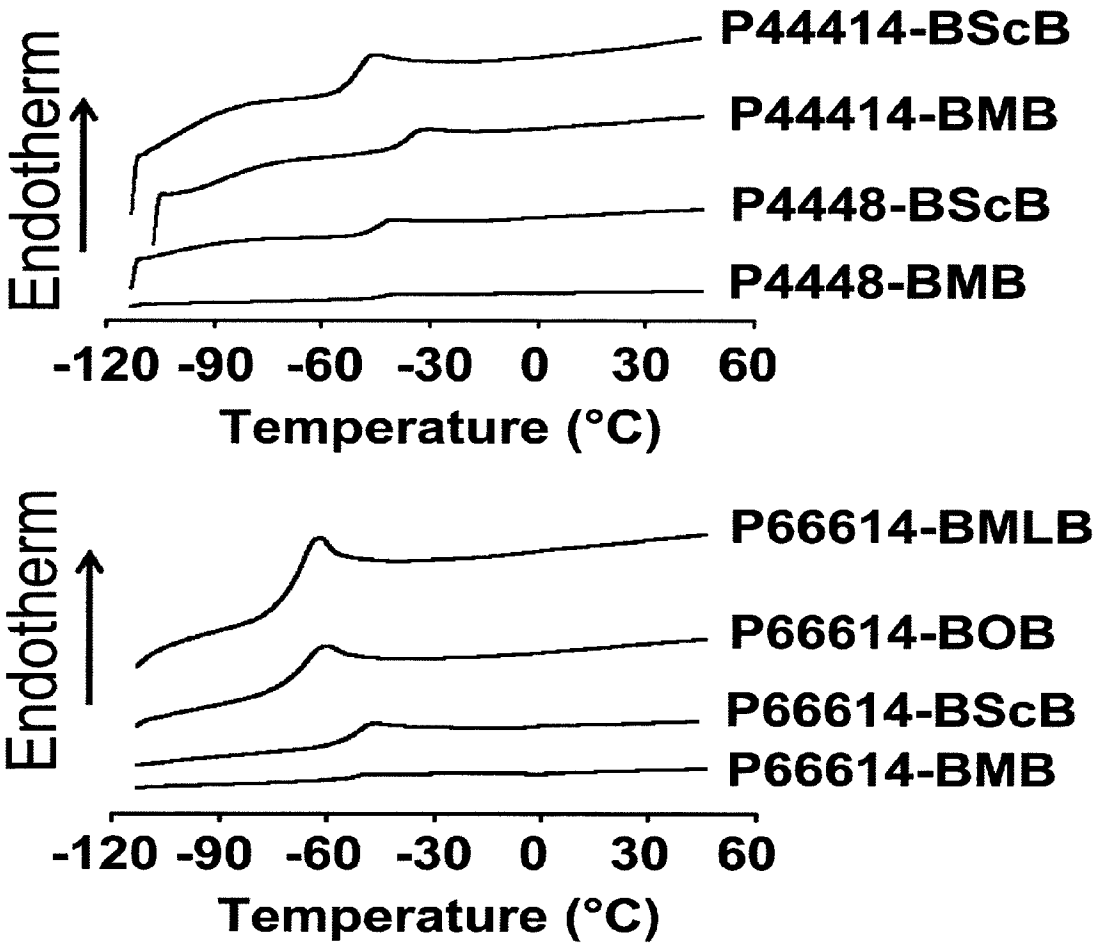
FIG. 1 shows DSC thermograms of novel halogen-free boron based ionic hf-BILs liquids.

Regarding n in R, R'=$C_nH_{2n+1}$ of tetraalkylphosphonium cations, it is noted that borate with shorter (both linear and branched) alkyl chains are less miscible in oils (in particular, with mineral oils), while longer chain alkyl groups (both linear and branched) have higher miscibility with mineral oils. Therefore, an increase in the length of alkyl groups (n) is expected to result in a more homogeneous lubricant. However, the length of R and R' should be optimized for each specific type of the oil and an optimum temperature interval for the lubricant, because too long alkyl chains will lead to a lower mobility of the additive in lubricant and, therefore, to compromised both anti-wear and friction reducing efficiency of the additive. Therefore, n is at least 1 and could be up to about 80 without negatively affecting the performance of the compound according to the invention.

In order to be well miscible with today's engine oils, such as POA 40 and POA 60 (Statoil) having carbon chain lengths of 40 and 60 carbon atoms, respectively, the value of n should be no less than 40 and 60, respectively. Thus, in one embodiment $n \leq 60$. The limit $n \leq 80$ is motivated by possible future products of motor oils with even longer alkyl chains, supposedly up to at least n=80.

A skilled person can in the light of the description make a routine optimization experiment and determine a suitable value of n and branched or/and non-branched character of the alkyl groups in tetraalkylphosphonium, imidazolium and pyrrolidinium cations.

It is conceived to use the lubricant components for reducing friction and reducing wear on a number of different materials both metals and non-metals. Examples of non-metals include but are not limited to ceramics with/without DLC (diamond-like-coatings) or/and graphene-based coatings. Examples of metals include but are not limited to alloys, steel, and aluminium with/without DLC (diamond-like-coatings) or/and graphene-based coatings.

A new family of hf-BILs was synthesized and purified following an improved protocol and a detailed study of their tribological and physicochemical properties including thermal behavior, density and viscosity, was carried out. The tribological properties were studied with 100Cr6 steel balls on an AA2024 aluminum disc in a rotating pin-on-disc test.

All compounds tested from this novel class of hf-BILs have outstanding antiwear as well as friction performance as compared with the fully formulated engine oil.

Synthesis schemes for the halogen free boron based ionic liquids according to the invention are shown below:

Scheme 1: Synthesis of bis(mandelato)borate base hf-BILs

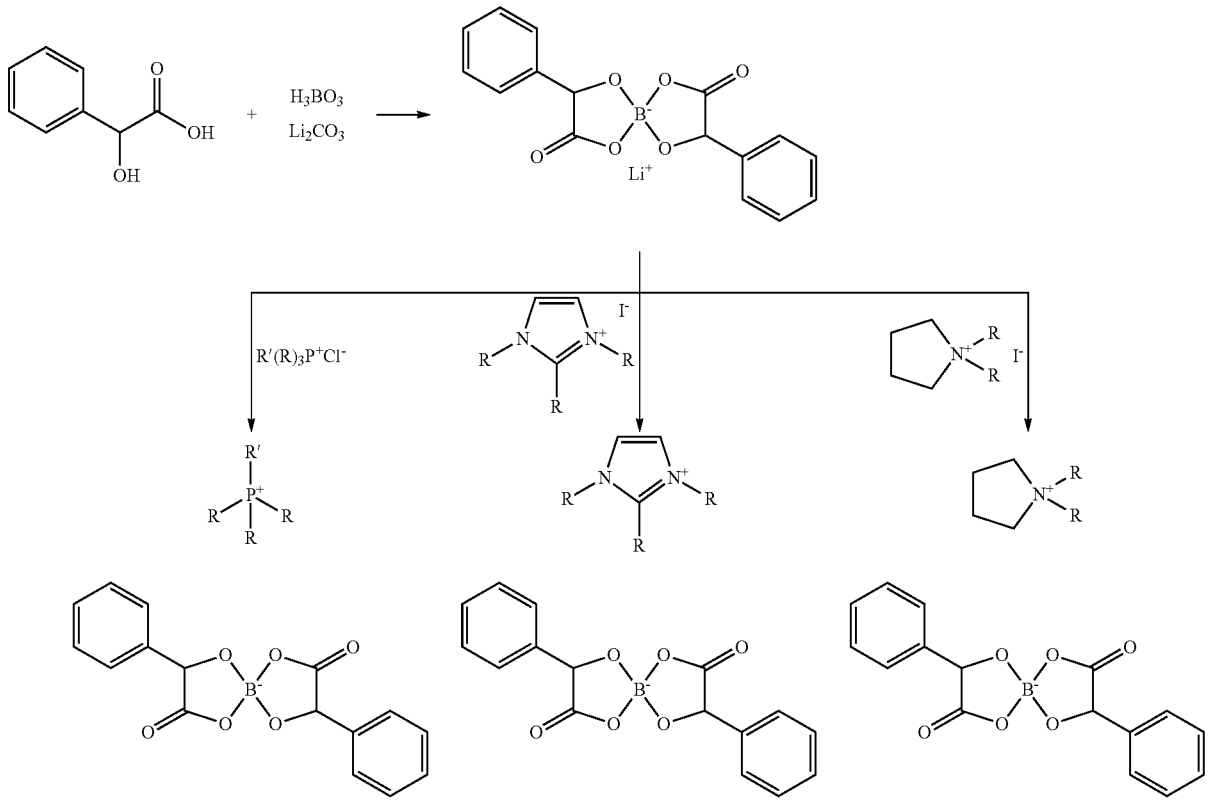

$R = C_nH_{2n+1}$; $n \geq 1$

Scheme 2: Synthesis of bis(salicylato)borate base hf-BILs

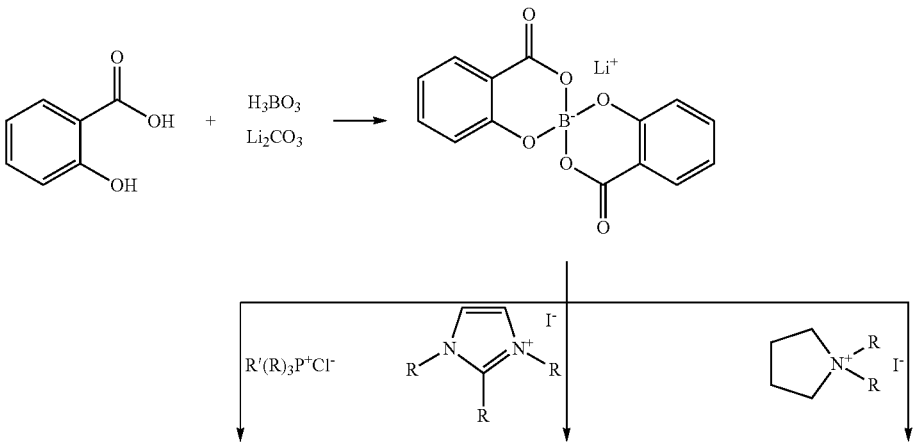

-continued
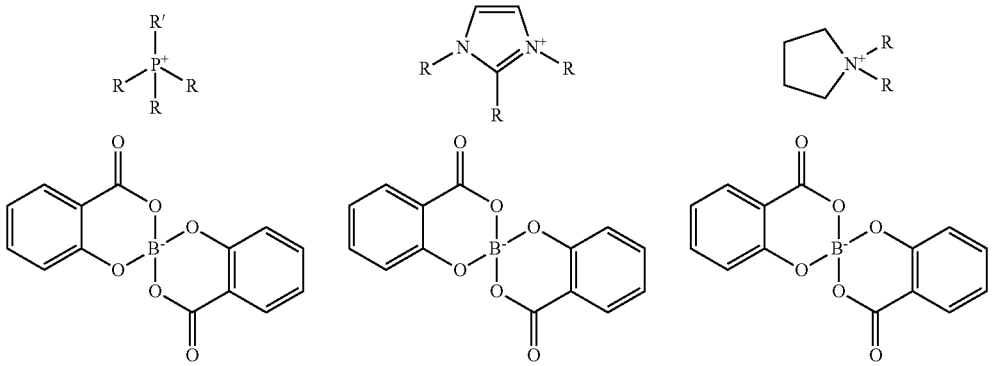
R = $C_nH_{2n+1}$; n ≥ 1
Scheme 3: Synthesis of bis(oxalato)borate base hf-BILs
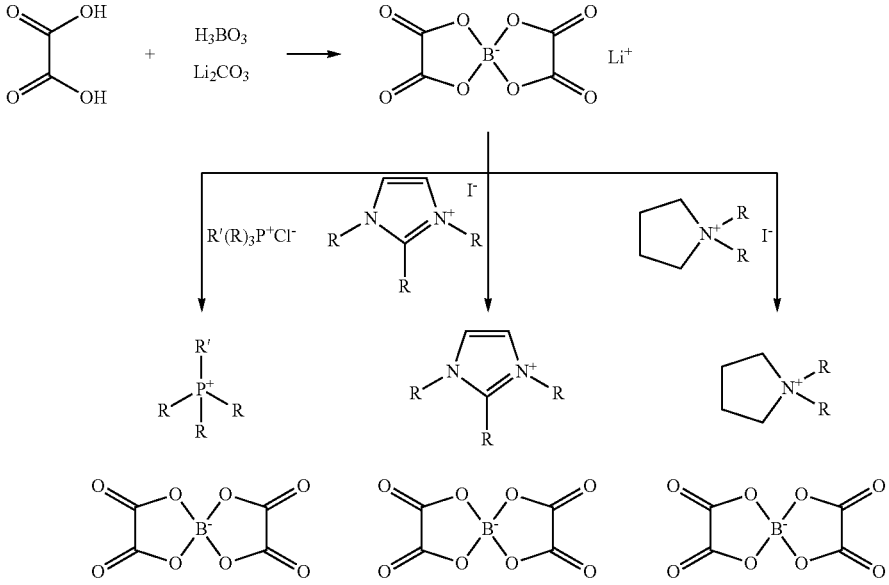
R = $C_nH_{2n+1}$; n ≥ 1
Scheme 4: Synthesis of bis(malonato)borate base hf-BILs
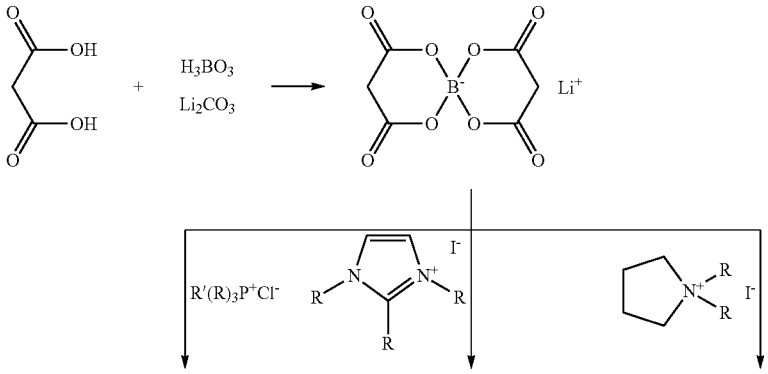

-continued

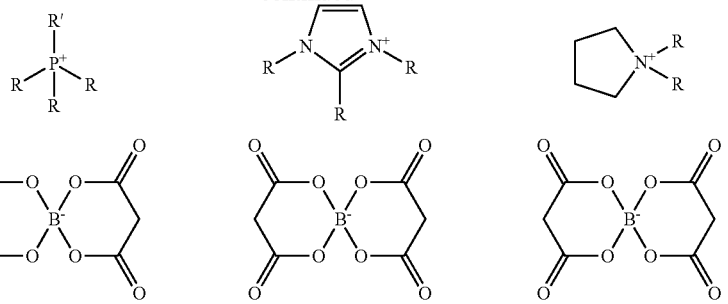

R = $C_nH_{2n+1}$; n ≥ 1

Synthesis

All novel halogen-free boron based ionic liquids (hf-BILs) were synthesized and purified using a modified literature methods.

Example 1

Tributyloctylphosphonium bis(mandelato)borate ([P4448][BMB])

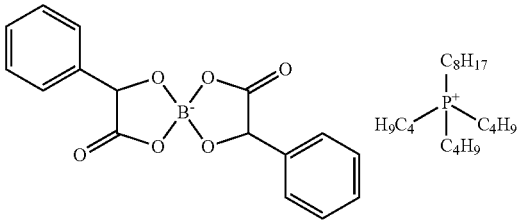

Mandelic acid (3.043 g, 20 mmol) was added slowly to an aqueous solution of lithium carbonate (0.369 g, 5 mmol) and boric acid (0.618 g, 10 mmol) in 50 mL water. The solution was heated up to about 60° C. for two hours. The reaction was cooled to room temperature and tributyloctylphosphonium chloride (3.509 g, 10 mmol) was added. The reaction mixture was stirred for two hours at room temperature. The organic layer of reaction product formed was extracted with 80 mL of $CH_2Cl_2$. The $CH_2Cl_2$ organic layer was washed three times with 60 mL water. The $CH_2Cl_2$ was rotary evaporated at reduced pressure and product was dried in a vacuum oven at 60 for 2 days. A viscous colorless ionic liquid was obtained in 84% yield (5.30 g). m/z ESI-MS (−): 311.0 $[BMB]^-$; m/z ESI-MS (+): 315.3 $[P4448]^+$.

Example 2

Tributyltetradecylphosphonium bis(mandelato)borate ([P44414][BMB])

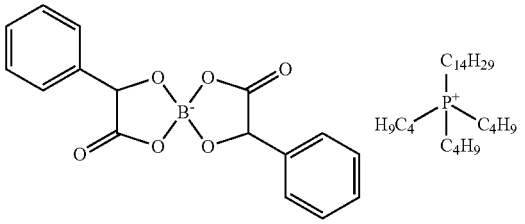

The procedure is similar to that used in the synthesis of [P4448][BMB]. The reaction started with (0.369 g, 5 mmol) of lithium carbonate, (0.618 g, 10 mmol) of boric acid, (3.043 g, 20 mmol) of mandelic acid and tributyltetradecylphosphonium chloride (4.349 g, 10 mmol). A viscous colorless ionic liquid was obtained in 81% yield (5.75 g). m/z ESI-MS (−): 310.9 $[BMB]^-$; m/z ESI-MS (+): 399.2 $[P44414]^+$.

Example 3

Trihexyltetradecylphosphonium bis(mandelato)borate ([P66614][BMB])

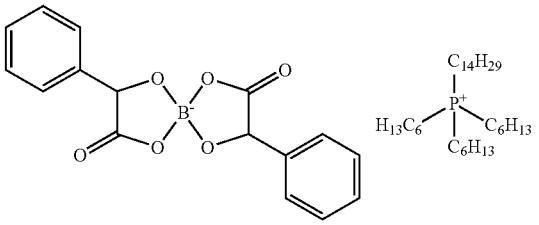

The procedure is similar to that used in the synthesis of [P4448][BMB]. The reaction started with (0.369 g, 5 mmol) of lithium carbonate, (0.618 g, 10 mmol) of boric acid, (3.043 g, 20 mmol) of mandelic acid and trihexyltetradecylphosphonium chloride (5.189 g, 10 mmol). A viscous colorless ionic liquid was obtained in 91% yield (7.25 g). m/z ESI-MS (−): 311.0 $[BMB]^-$; m/z ESI-MS (+): 483.3 $[P66614]^+$.

Example 4

Tributyloctylphosphonium bis(salicylato)borate ([P4448][BScB])

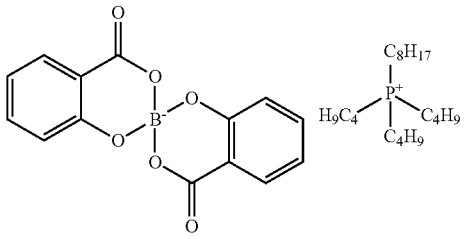

The procedure is similar to that used in the synthesis of [P4448][BMB]. The reaction started with (0.369 g, 5 mmol) of lithium carbonate, (0.618 g, 10 mmol) of boric acid, (2.762 g, 20 mmol) of salicylic acid and tributyloctylphosphonium chloride (3.509 g, 10 mmol). A viscous colorless ionic liquid was obtained in 88% yield (5.28 g). m/z ESI-MS (−): 283.1 $[BScB]^-$; m/z ESI-MS (+): 315.3 $[P4448]^+$.

Example 5

Tributyltetradecylphosphonium bis(salicylato)borate ([P44414][BScB])

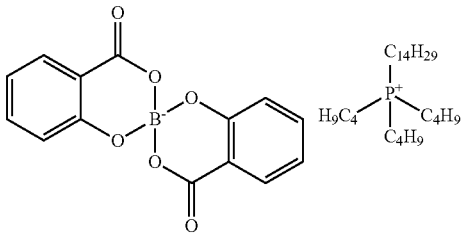

The procedure is similar to that used in the synthesis of [P4448][BMB]. The reaction started with (0.369 g, 5 mmol) of lithium carbonate, (0.618 g, 10 mmol) of boric acid, (2.762 g, 20 mmol) of salicylic acid and tributyltetradecylphosphonium chloride (4.349 g, 10 mmol). A viscous colorless ionic liquid was obtained in 94% yield (6.44 g). m/z ESI-MS (−): 283.0 $[BScB]^-$; m/z ESI-MS (+): 399.4 $[P44414]^+$.

Example 6

Trihexyltetradecylphosphonium bis(salicylato)borate ([P66614][BScB])

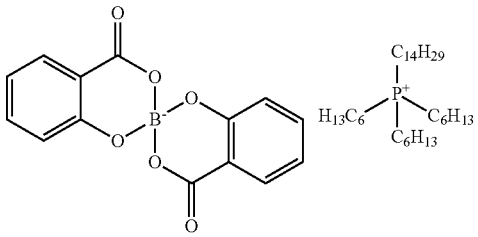

The procedure is similar to that used in the synthesis of [P4448][BMB]. The reaction started with (0.369 g, 5 mmol) of lithium carbonate, (0.618 g, 10 mmol) of boric acid, (2.762 g, 20 mmol) of salicylic acid and trihexyltetradecylphosphonium chloride (5.189 g, 10 mmol). A viscous colorless ionic liquid was obtained in 95% yield (7.30 g). m/z ESI-MS (−): 283.0 $[BScB]^-$; m/z ESI-MS (+): 483.5 $[P66614]^+$.

Example 7

Tributyltetradecylphosphonium bis(oxalato)borate ([P44414][BScB])

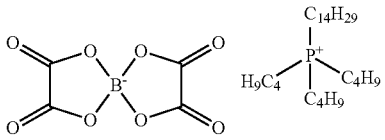

The procedure is similar to that used in the synthesis of [P4448][BMB]. The reaction started with (0.369 g, 5 mmol) of lithium carbonate, (0.618 g, 10 mmol) of boric acid, (1.80 g, 20 mmol) of oxalic acid and tributyltetradecylphosphonium chloride (4.349 g, 10 mmol). A viscous colorless ionic liquid was obtained.

Example 8

Trihexyltetradecylphosphonium bis(oxalato)borate ([P66614][BOB])

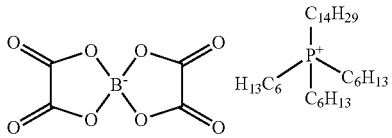

The procedure is similar to that used in the synthesis of [P4448][BMB]. The reaction started with (0.369 g, 5 mmol) of lithium carbonate, (0.618 g, 10 mmol) of boric acid, (1.80 g, 20 mmol) of oxalic acid and trihexyltetradecylphosphonium chloride (5.189 g, 10 mmol). A viscous colorless ionic liquid was obtained. m/z ESI-MS (−): $[BOB]^-$; m/z ESI-MS (+): 483.5 $[P66614]^+$.

Example 9

Tributyltetradecylphosphonium bis(malonato)borate ([P44414][BMLB])

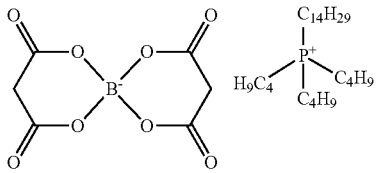

The procedure is similar to that used in the synthesis of [P4448][BMB]. The reaction started with (0.369 g, 5 mmol) of lithium carbonate, (0.618 g, 10 mmol) of boric acid, (2.081 g, 20 mmol) of malonic acid and tributyltetradecylphosphonium chloride (4.349 g, 10 mmol). A viscous colorless ionic liquid was obtained.

Example 10

Trihexyltetradecylphosphonium bis(malonato)borate ([P66614][BMLB])

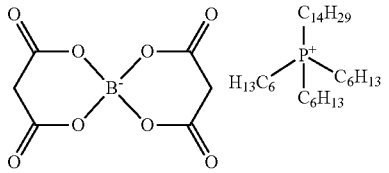

The procedure is similar to that used in the synthesis of [P4448][BMB]. The reaction started with (0.369 g, 5 mmol) of lithium carbonate, (0.618 g, 10 mmol) of boric acid, (2.081 g, 20 mmol) of malonic acid and trihexyltetradecylphosphonium chloride (5.189 g, 10 mmol). A viscous colorless ionic liquid was obtained. m/z ESI-MS (−): $[BMLB]^-$; m/z ESI-MS (+): 483.5 $[P66614]^+$.

Example 11

Tributyltetradecylphosphonium bis(succinato)borate ([P44414][BSuB])

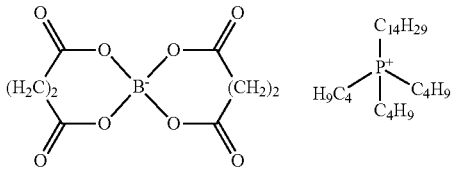

The procedure is similar to that used in the synthesis of [P4448][BMB]. The reaction started with (0.369 g, 5 mmol) of lithium carbonate, (0.618 g, 10 mmol) of boric acid, (2.362 g, 20 mmol) of succinic acid and tributyltetradecylphosphonium chloride (4.349 g, 10 mmol). A viscous colorless ionic liquid was obtained.

Example 12

Trihexyltetradecylphosphonium bis(succinato)borate ([P66614][B SuB])

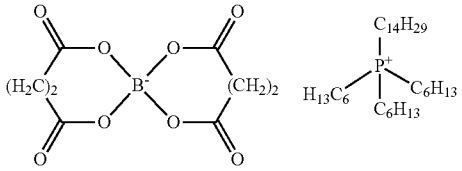

The procedure is similar to that used in the synthesis of [P4448][BMB]. The reaction started with (0.369 g, 5 mmol) of lithium carbonate, (0.618 g, 10 mmol) of boric acid, (2.362 g, 20 mmol) of succinic acid and trihexyltetradecylphosphonium chloride (5.189 g, 10 mmol). A viscous colorless ionic liquid was obtained.

Example 13

Tributyltetradecylphosphonium bis(glutarato)borate ([P44414][BMB])

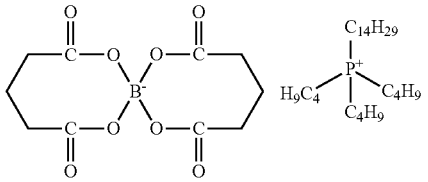

The procedure is similar to that used in the synthesis of [P4448][BMB]. The reaction started with (0.369 g, 5 mmol) of lithium carbonate, (0.618 g, 10 mmol) of boric acid, (2.642 g, 20 mmol) of glutaric acid and tributyltetradecylphosphonium chloride (4.349 g, 10 mmol). A viscous colorless ionic liquid was obtained.

Example 14

Trihexyltetradecylphosphonium bis(glutarato)borate ([P66614][BGklB])

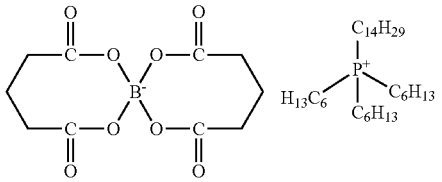

The procedure is similar to that used in the synthesis of [P4448][BMB]. The reaction started with (0.369 g, 5 mmol) of lithium carbonate, (0.618 g, 10 mmol) of boric acid, (2.642 g, 20 mmol) of glutaric acid and trihexyltetradecylphosphonium chloride (5.189 g, 10 mmol). A viscous colorless ionic liquid was obtained.

Example 15

Tributyltetradecylphosphonium bis(adipato)borate ([P44414][BAdB])

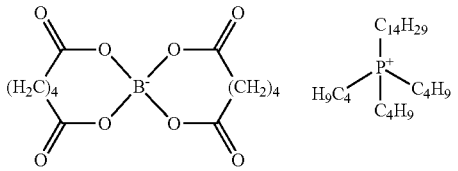

The procedure is similar to that used in the synthesis of [P4448][BMB]. The reaction started with (0.369 g, 5 mmol) of lithium carbonate, (0.618 g, 10 mmol) of boric acid, (2.923 g, 20 mmol) of adipic acid and tributyltetradecylphosphonium chloride (4.349 g, 10 mmol). A viscous colorless ionic liquid was obtained.

Example 16

Trihexyltetradecylphosphonium bis(adipato)borate ([P66614][BAdB])

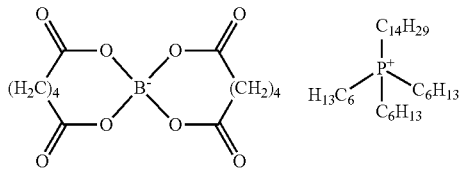

The procedure is similar to that used in the synthesis of [P4448][BMB]. The reaction started with (0.369 g, 5 mmol) of lithium carbonate, (0.618 g, 10 mmol) of boric acid, (2.923 g, 20 mmol) of adipic acid and trihexyltetradecylphosphonium chloride (5.189 g, 10 mmol). A viscous colorless ionic liquid was obtained.

Example 17

Choline bis(salicylato)borate ([Choline][BScB])

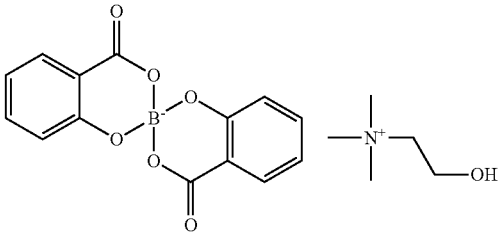

Salicylic acid (5.524 g, 40 mmol) was added slowly to an aqueous solution of lithium carbonate (0.738 g, 10 mmol) and boric acid (1.236 g, 20 mmol) in 40 mL water. The solution was heated upto about 60° C. for two hours. The reaction was cooled to room temperature and choline chloride (2.792 g, 20 mmol) was added. The reaction mixture was stirred for two hours at room temperature. The organic layer of reaction product formed was extracted with 80 mL of $CH_2Cl_2$. The $CH_2Cl_2$ organic layer was washed three times with 80 mL water. The $CH_2Cl_2$ was rotary evaporated at reduced pressure and the product was dried in a vacuum oven at 60 for 2 days. A white solid ionic liquid was recrystallized from $CH_2Cl_2$ (5.44 g, 70% yield). m/z ESI-MS (−): 283.0 $[BScB]^-$; m/z ESI-MS (+): 103.9 $[Choline]^+$.

Example 18

N-ethyl-N-methylpyrrolidinium bis(salicylato)borate ([EMPy][BScB])

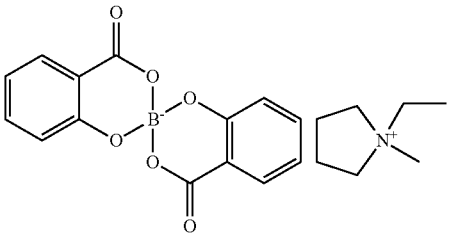

Salicylic acid (5.524 g, 40 mmol) was added slowly to an aqueous solution of lithium carbonate (0.738 g, 10 mmol) and boric acid (1.236 g, 20 mmol) in 40 mL water. The solution was heated upto about 60° C. for two hours. The reaction was cooled to room temperature and N-ethyl-N-methylpyrrolidinium iodide (4.822 g, 20 mmol) was added. The reaction mixture was stirred for two hours at room temperature. The organic layer of reaction product formed was extracted with 80 ml of $CH_2Cl_2$. The $CH_2Cl_2$ organic layer was washed three times with 80 mL water. The $CH_2Cl_2$ was rotary evaporated at reduced pressure and the product was dried in a vacuum oven at 60 for 2 days. A white solid ionic liquid was recrystallized from $CH_2Cl_2$ (6.167 g, 78% yield). m/z ESI-MS (−): 283.0 $[BScB]^-$; m/z ESI-MS (+): 113.9 $[EMPy]^+$.

Example 19

N-ethyl-N-methylpyrrolidinium bis(mandelato)borate [EMPy][BMB]

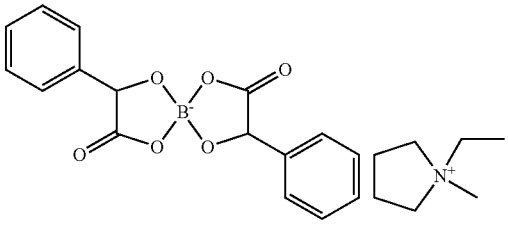

The procedure is similar to that used in the synthesis of [EMPy][BScB]. The reaction started with lithium carbonate (0.369 g, 5 mmol), boric acid (0.618 g, 10 mmol), mandelic acid (3.043 g, 20 mmol) and N-ethyl-N-methylpyrrolidinium iodide (2.41 g, 10 mmol). A viscous ionic liquid was obtained in 67% yield (2.85 g). MS (ESI) calcd for $[C_6H_{16}N]^+$ m/z 114.2. found m/z 114.1; calcd for $[C_{16}H_{12}O_6B]^-$ m/z 311.0. found m/z 311.0.

Example 20

1-ethyl-2,3-dimethylimidazolium bis(mandelato)borate [EMIm][BMB]

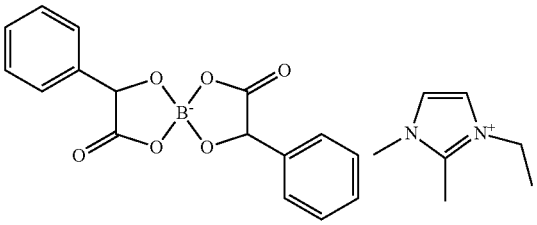

Mandelic acid (3.043 g, 20 mmol) was added slowly to an aqueous solution of lithium carbonate (0.369 g, 5 mmol) and boric acid (0.618 g, 10 mmol) in 50 mL water. The solution was heated upto about 60° C. for two hours. The reaction was cooled to room temperature and 1-ethyl-2,3-dimethylimidazolium iodide (2.52 g, 10 mmol) was added. The reaction mixture was stirred for two hours at room temperature. The bottom layer of the reaction product formed was extracted with 80 mL of $CH_2Cl_2$. The $CH_2Cl_2$ organic layer was washed three times with 100 mL water. The $CH_2Cl_2$ was rotary evaporated at reduced pressure and the final product was dried in a vacuum oven at 60° C. for 2 days. A viscous ionic liquid was obtained in 78% yield (3.40 g).

MS (ESI) calcd for $[C_7H_{13}N_2]^+$ m/z 125.2. found m/z 125.2; calcd for $[C_{16}H_{12}O_6B]^-$ m/z 311.0. found m/z 311.1.

Example 21

1-ethyl-2,3-dimethylimidazolium bis(salicylato)borate [EMIm][BScB]

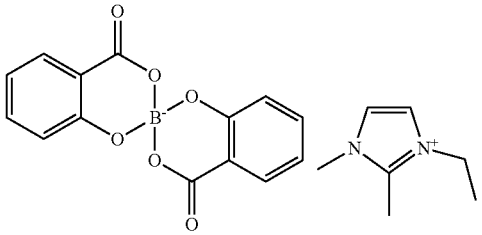

The procedure is similar to that used in the synthesis of [EMIm][BMB]. The reaction started with lithium carbonate (0.369 g, 5 mmol), boric acid (0.618 g, 10 mmol), salicylic acid (2.762 g, 20 mmol) and 1-ethyl-2,3-dimethylimidazolium iodide (2.52 g, 10 mmol). A white solid product was obtained in 83% yield (3.38 g). MS (ESI) calcd for $[C_7H_{13}N_2]^+$ m/z 125.2. found m/z 125.1; calcd for $[C_{14}H_8O_6B]^-$ m/z 283.0. found m/z 283.0.

Example 22

1-methylimidazole-trimethylamine-$BH_2$ bis(mandelato)borate [MImN111$BH_2$][BMB]

Mandelic acid (3.043 g, 20 mmol) was added slowly to an aqueous solution of lithium carbonate (0.369 g, 5 mmol) and boric acid (0.618 g, 10 mmol) in 50 mL water. The solution was heated upto about 60° C. for two hours. The reaction was cooled to room temperature and 1-methylimidazole trimethylamine $BH_2$ iodide (2.70 g, 10 mmol) was added. The reaction mixture was stirred for two hours at room temperature. The bottom layer of the reaction product formed was extracted with 80 mL of $CH_2Cl_2$. The $CH_2Cl_2$ organic layer was washed three times with 100 mL water. The $CH_2Cl_2$ was rotary evaporated at reduced pressure and the final product was dried in a vacuum oven at 60° C. for 2 days.

Example 23

1,2-dimethylimidazole-trimethylamine-$BH_2$ bis(mandelato)borate [MMImN111$BH_2$][BMB]

The procedure is similar to that used in the synthesis of [MimN111$BH_2$][BMB]. The reaction started with lithium carbonate (0.369 g, 5 mmol), boric acid (0.618 g, 10 mmol), mandelic acid (3.043 g, 20 mmol) and 1,2-dimethylimidazole trimethylamine $BH_2$ iodide (2.841 g, 10 mmol) was added. A liquid product was obtained.

Example 24

1-methylimidazole-trimethylamine-$BH_2$ bis(salicylato)borate [MImN111$BH_2$][BScB]

Salicylic acid (5.524 g, 40 mmol) was added slowly to an aqueous solution of lithium carbonate (0.738 g, 10 mmol) and boric acid (1.236 g, 20 mmol) in 40 mL water. The solution was heated upto about 60° C. for two hours. The reaction was cooled to room temperature and 1-methylimidazole trimethylamine $BH_2$ iodide (5.40 g, 20 mmol) was added. The reaction mixture was stirred for two hours at room temperature. The organic layer of reaction product formed was extracted with 80 ml of $CH_2Cl_2$. The $CH_2Cl_2$ organic layer was washed three times with 80 mL water. The $CH_2Cl_2$ was rotary evaporated at reduced pressure and the product was dried in a vacuum oven at 60 for 2 days. A liquid product was obtained.

Example 25

1,2-dimethylimidazole-trimethylamine-$BH_2$ bis(salicylato)borate [MMImN111$BH_2$][BScB]

The procedure is similar to that used in the synthesis of [MImN111$BH_2$][BScB]. The reaction started with lithium carbonate (0.369 g, 5 mmol), boric acid (0.618 g, 10 mmol), salicylic acid (2.762 g, 20 mmol) and 1,2-dimethylimidazole trimethylamine $BH_2$ iodide (2.841 g, 10 mmol) was added. A liquid product was obtained.

Instrumentation Used in the Invention

NMR experiments were collected on a Bruker Avance 400 (9.4 Tesla magnet) with a 5 mm broadband autotunable probe with Z-gradients at 30° C. NMR spectra were collected and processed using the spectrometer "Topspin" 2.1 software. $^1H$ and $^{13}C$ spectra were reference to internal TMS and $CDCl_3$. External references were employed in the $^{31}P$ (85% $H_3PO_4$) and $^{11}B$ ($Et_2O.BF_3$).

The positive and negative ion electrospray mass spectra were obtained with a Micromass Platform 2 ESI-MS instrument.

A Q100 TA instrument was used for differential scanning calorimetric (DSC) measurements to study the thermal behavior of hf-BILs. An average weight of 5-10 mg of each sample was sealed in an aluminum pan and cooled to −120° C. then heated upto 50° C. at a scanning rate of 10.0° C./min.

Viscosity of these hf-BILs was measured with an AMVn Automated Microviscometer in a temperature range from 20 to 90° C. using a sealed sample tube.

The wear tests were conducted at room temperature (22° C.) on a Nanovea pin-on-disk tester according to ASTM G99 using 6 mm 100Cr6 balls on 45 mm diameter AA2024 aluminum disks. The composition, Vicker's hardness and average roughness, $R_a$, of the steel balls and aluminum disks are shown in Table 1. The disks were lubricated with 0.1 mL of lubricant. Experiments were conducted at loads of 20 and 40 N for a distance of 1000 m, with a wear track diameter of 20 mm and a speed of 0.2 m/s. The friction coefficient was recorded throughout the experiment. On completion of the wear tests, the wear depth was measured using a Dektak 150 stylus profilometer.

TABLE 1

Composition, hardness and roughness of alloys used in this study

| Elemental Composition | Alloy | |
|---|---|---|
| (wt %) | AA2024 | 100Cr6 |
| C | — | 0.98-1.10 |
| Cu | 3.8-4.9 | — |
| Si | 0.5 max | 0.15-0.3 |
| Mn | 0.3-0.9 | 0.25-0.45 |

TABLE 1-continued

Composition, hardness and roughness of alloys used in this study

| Elemental Composition (wt %) | Alloy AA2024 | Alloy 100Cr6 |
|---|---|---|
| Mg | 1.2-1.8 | — |
| Cr | 0.1 max | 1.3-1.6 |
| Zn | 0.25 max | |
| Ti | 0.15 max | |
| S | — | 0.025 max |
| P | — | 0.025 max |
| Others | 0.15 max | — |
| Fe | 0.5 max | Balance |
| Al | Balance | — |
| Hardness (Vickers) | 145 | 850 |
| $R_a$ (μm) | 0.09 | 0.05 max |

Results and Discussion on the Invention

Thermal Behaviour of hf-BILs

FIG. 1 shows the differential scanning calorimetry (DSC) traces of hf-BILs under discussion. All these hf-BILs are liquids at room temperature and they exhibit glass transitions below room temperature (−44° C. to −73° C.). Glass transition temperatures ($T_g$) for these hf-BILs are also tabulated in Table 2. It is known that $T_g$ of orthoborate ionic liquids are higher than those for the corresponding salts of the fluorinated anions. $T_g$ of the orthoborate ionic liquids with the cation $P66614^+$ and different anions decreases in the order $BMB^-$>$BScB^-$>$BOB^-$>$BMLB^-$. hf-BILs with $BMB^-$ and $BScB^-$ have considerably higher $T_g$ values compared with these of hf-BILs with $BScB^-$ and BMLW, most probably because of the phenyl rings present in the structure of the former anions (BMW and BScW).

For common orthoborate anions with different phosphonium cations, a decrease in $T_g$ is observed with an increase in size of alkyl chains in the cations. This trend is more easily seen in hf-BILs with the BScW anion and different phosphonium cations: $T_g$ fall in the order $P4448^+$ (−49° C.)>$P44414^+$ (−54° C.)>$P66616^+$ (−56° C.) (see Table 2). Del Sesto et al. have observed a similar trend for ionic liquids of phosphonium cations with bistrifylamide ($NTf_2$) and dithiomaleonitrile (dtmn) anions. Lowest $T_g$ of hf-BILs (down to −73° C. for P66614-BMLB) are reached with $P66616^+$ as the cation, probably because of a larger size, lower symmetry and a low packing efficiency of this cation.

Density Measurements of hf-BILs

Figure 2:
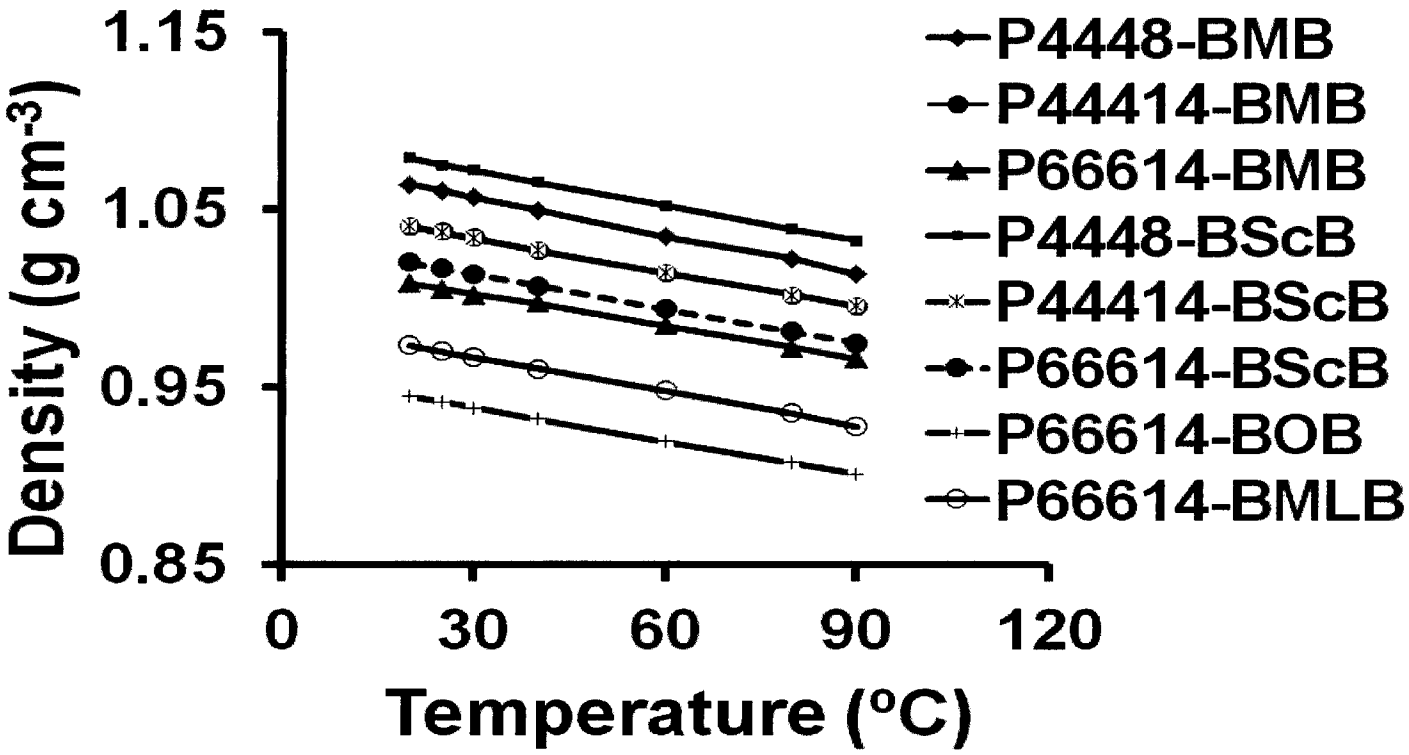
FIG. 2 shows densities of novel halogen-free boron based ionic liquids (hf-BILs) as a function of temperature.

FIG. 2 shows a linear variation of densities with temperature for hf-BILs. By comparing the effect of anions on the densities of hf-BILs, densities fall in the order $BScB^-$ > $BMB^-$>$BOB^-$>$BMLB^-$. For the same anion, density of hf-BILs decreases with an increase in the size of the cation as $P4448^+$>$P44414^+$>$P66616^+$. The density values of P44414-BMB and P44414-BScB are very similar at all measured temperatures. Density of hf-BILs decreases with an increase in the length of alkyl chains in cations, because the van der Walls interactions are reduced and that leads to a less efficient packing of ions. The parameters characterizing density of these hf-BILs as a function of temperature are tabulated in Table 2. For increasing temperatures from +20 to +90° C., density of hf-BILs decreases linearly. This behaviour is usual for ionic liquids.

TABLE 2

Physical Properties of halogen-free boron based ionic liquids (hf-BILs)

| hf-BILs | Density equation $d = b - aT/g\ cm^{-3}$ (where T is ° C.) a | B | $R^2$ | Ea (η)/ kcal $mol^{-1}$ | $T_g$/° C. from DSC measurement |
|---|---|---|---|---|---|
| P4448-BMB | $7 \times 10^{-4}$ | 1.0784 | 0.9991 | 12.2 | −46 |
| P44414-BMB | $7 \times 10^{-4}$ | 1.0541 | 0.9998 | 12.7 | −44 |
| P66614-BMB | $6 \times 10^{-4}$ | 1.0208 | 0.9995 | 11.6 | −55 |
| P4448-BScB | $7 \times 10^{-4}$ | 1.0919 | 0.9999 | 11.9 | −49 |
| P44414-BScB | $6 \times 10^{-4}$ | 1.0532 | 0.9998 | 10.8 | −54 |
| P66614-BScB | $7 \times 10^{-4}$ | 1.0333 | 1 | 10.6 | −56 |
| P66614-BOB | $6 \times 10^{-4}$ | 0.9571 | 0.9998 | 11.6 | −71 |
| P66614-BMLB | $6 \times 10^{-4}$ | 0.9865 | 0.9996 | 10.0 | −73 |

Dynamic Viscosity of Hf-BILs

Figure 3:
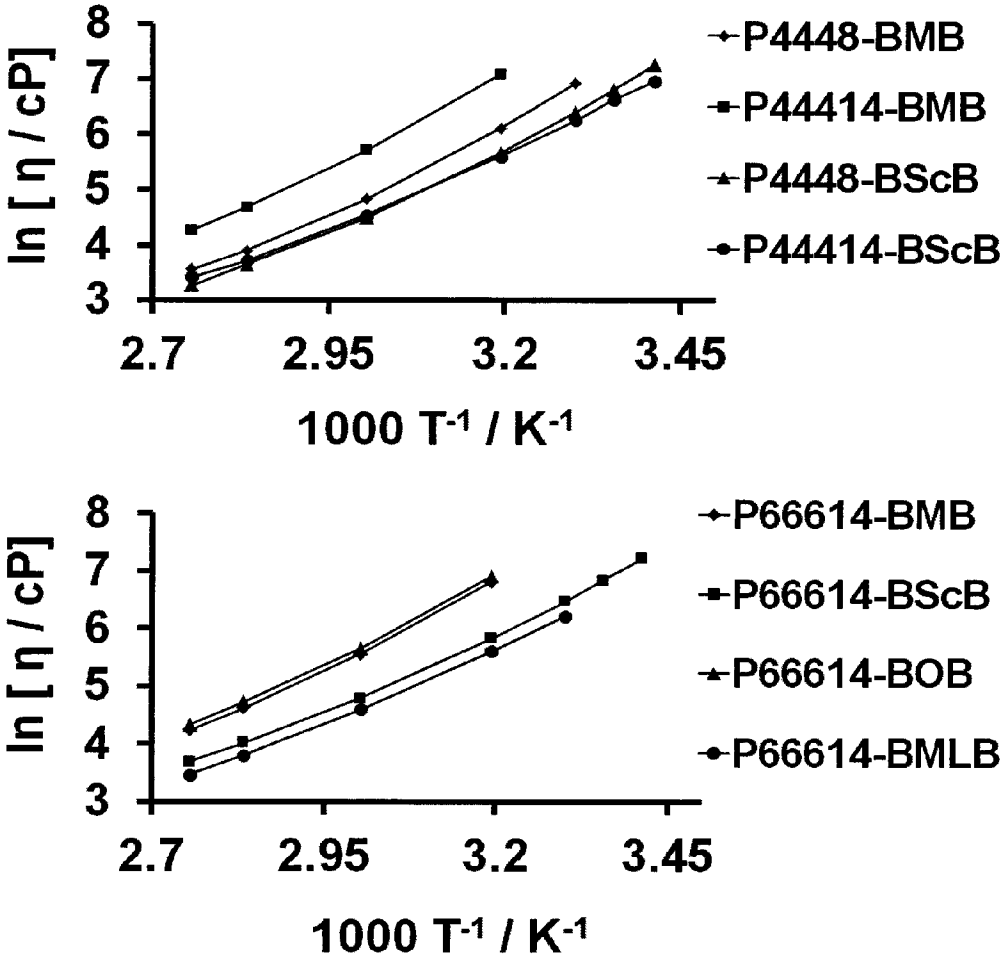
FIG. 3 shows an Arrhenius plot of viscosity for selected hf-BILs as a function of temperature.

FIG. 3 shows temperature dependences of viscosities of hf-BILs. These dependences can be fit to the Arrhenius equation for viscosity, $\eta=\eta_o\exp(E_a(\eta)/k_BT)$, in the whole temperature range studied. Here, $\eta_o$ is a constant and $E_a(\eta)$ is the activation energy for viscous flows. Activation energies, $E_a(\eta)$, for different hf-BILs are tabulated in Table 2.

Some of novel hf-BILs have shown very high viscosity in the temperature range between 20-30° C., which was not measurable by the viscometer used in this study. However, viscosity of hf-BILs decreases markedly with an increase in temperature (from ca 1000 cP at ca 20° C. down to ca 20 cP at ca 90° C., see FIG. 3). Viscosity of ionic liquids depends on electrostatic forces and van der Walls interactions, hydrogen bonding, molecular weight of the ions, geometry of cations and anions (a conformational degree of freedom, their symmetry and flexibility of alkyl chains), charge delocalization, nature of substituents and coordination ability. For a given cation, $P66616^+$, viscosities fall in the order $BMB^-$ ($E_a$=11.6 kcal $mol^{-1}$)>$BOB^-$ ($E_a$=11.6 kcal $mol^{-1}$)> $BScB^-$ ($E_a$=10.6 kcal $mol^{-1}$)>$BMLB^-$ ($E_a$=10.0 kcal $mol^{-1}$) (see Table 2).

Tribological Performance of hf-BILs

Figure 4:
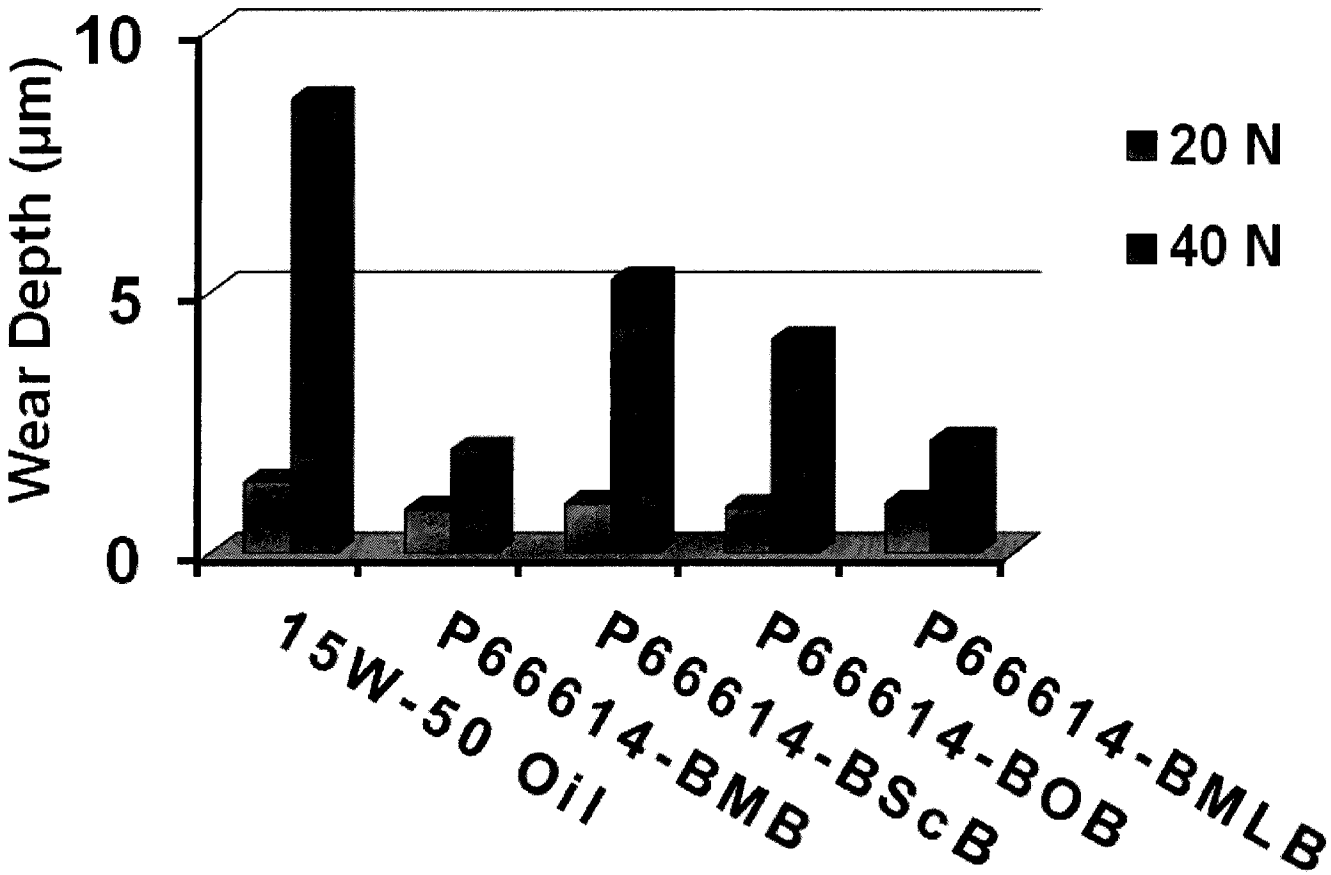
FIG. 4 shows the wear depths at 40 N load for 100Cr6 steel against AA2024 aluminum lubricated by hf-BILs in comparison with 15W-50 engine oil.

FIG. 4 compares the antiwear performance for hf-BILs with this for the 15W-50 engine oil at loads of 20 and 40 N for a sliding distance of 1000 m. The wear depths for the 15W-50 engine oil were 1.369 μm and 8.686 μm at 20 N and 40 N loads, respectively. hf-BILs have considerably reduced wear of aluminum used in this study, in particular, at a high load (40 N). For example, aluminum lubricated with P66614-BMB the wear depths were 0.842 μm and 1.984 μm at 20 N and 40 N loads, respectively.

Figure 5:
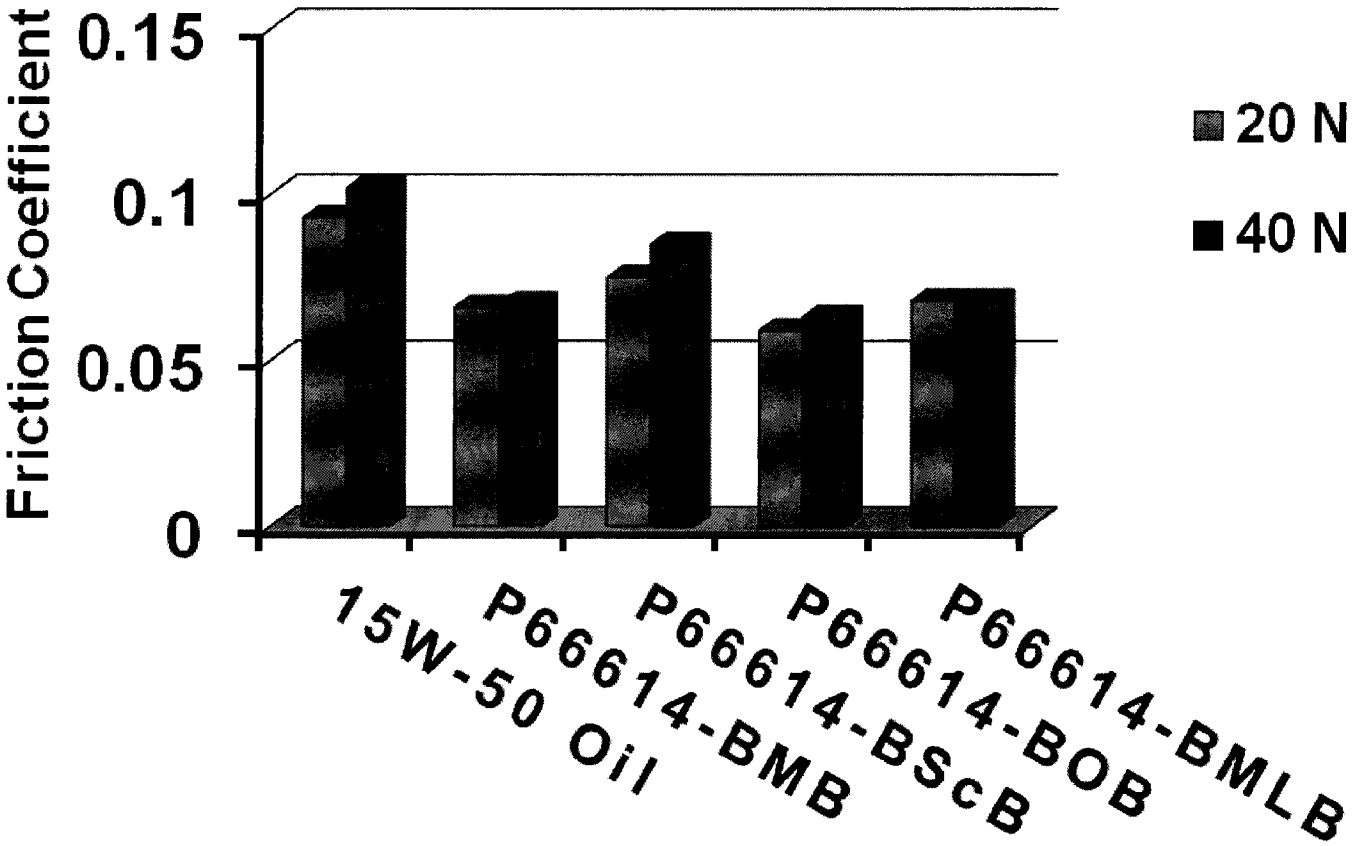
FIG. 5 shows the friction coefficients at 40 N load for 100Cr6 steel against AA2024 aluminum lubricated by hf-BILs in comparison with 15W-50 engine oil.

Mean friction coefficients for the selected hf-BILs in comparison with 15W-50 engine oil are shown in FIG. 5. The friction coefficients for the 15W-50 engine oil were 0.093 and 0.102 at 20 N and 40 N, respectively. All the tested hf-BILs have lower mean friction coefficients compared with 15W-50 engine oil. For example, the friction coefficients for P66614-BMB were 0.066 and 0.067 at 20 N and 40 N loads, respectively.

Figure 6:
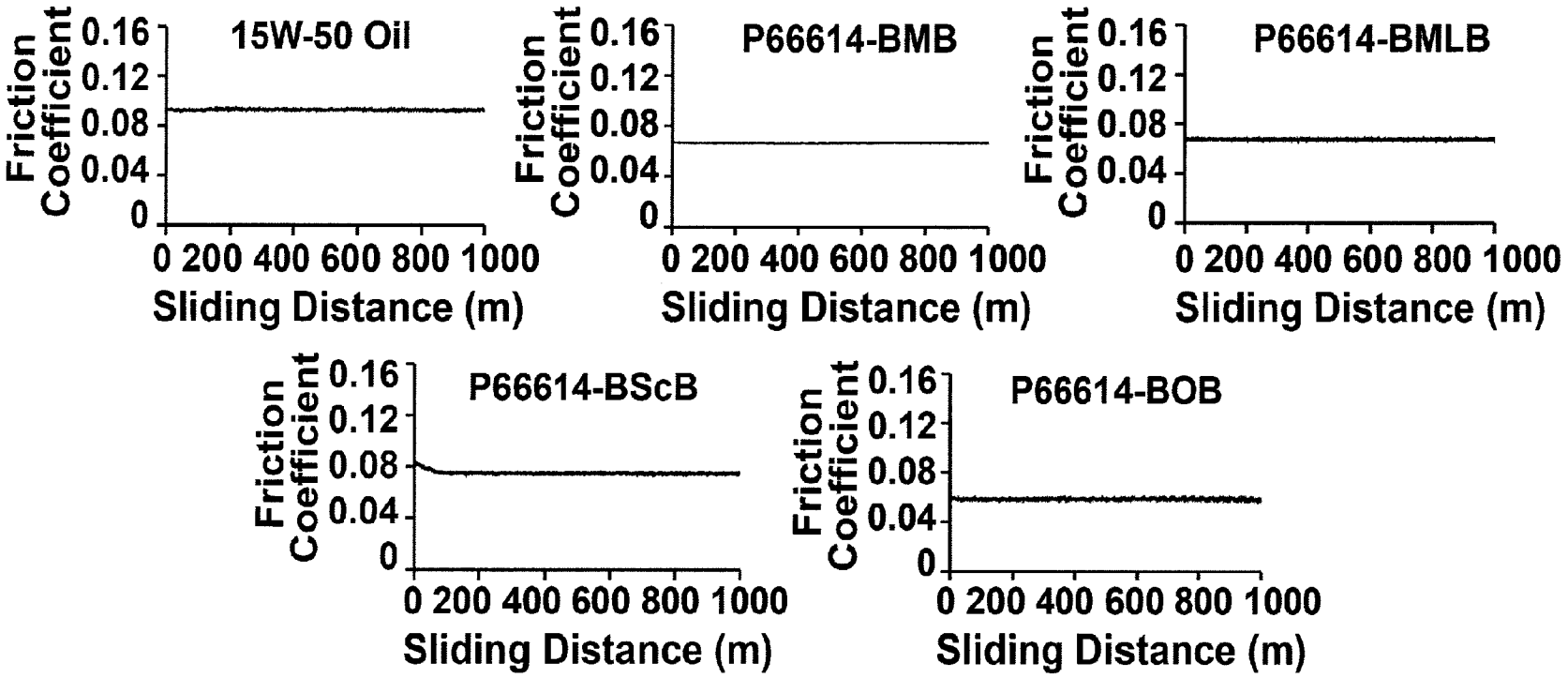
FIG. 6 shows the friction coefficient curves at 20 N load for 100Cr6 steel against AA2024 aluminium lubricated by hf-BILs in comparison with 15W-50 engine oil.
Figure 7:
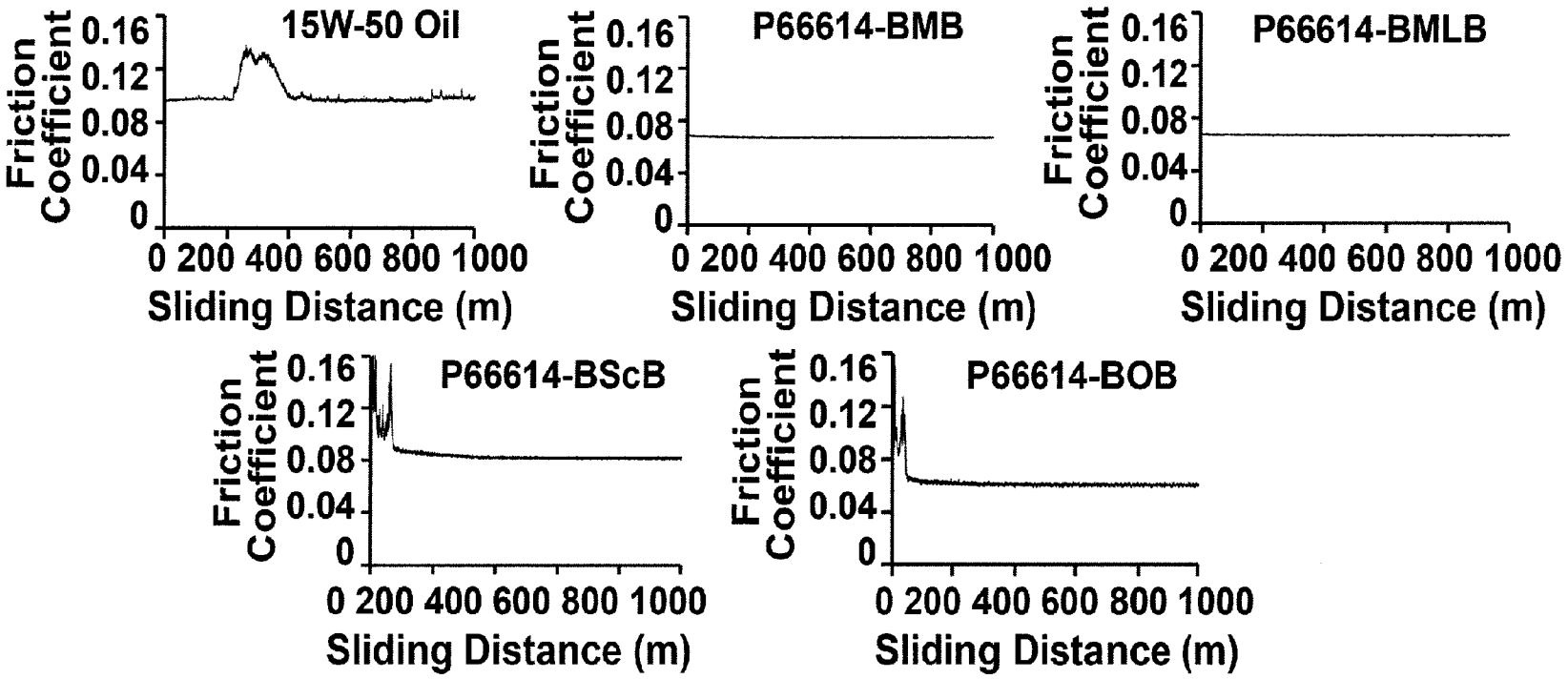
FIG. 7 shows the friction coefficient curves at 40 N load for 100Cr6 steel against AA2024 aluminum lubricated by hf-BILs in comparison with 15W-50 engine oil.

FIGS. 6 and 7 show time-traces of the friction coefficient for the selected hf-BILs and the 15W-50 engine oil at 20 N (FIG. 6) and 40 N (FIG. 7) during 1000 m sliding distance. The friction coefficients are stable at 20 N both for 15W-50 engine oil and hf-BILs. There is no an increase in the friction coefficients until the end of the test for all lubricants examined here. The friction coefficients for hf-BILs were lower than those for 15W-50 engine oil at all times of the test (see FIG. 3).

At the load of 40 N the friction coefficient for the 15W-50 engine oil varied considerably over a sliding distance. At the beginning of the test, the friction coefficient was stable but a sudden increase occurred at a sliding distance of ca 200 m and remained that high for a 400 m sliding distance. In the beginning of the test a thin tribofilm separated the surfaces and prevented them from a direct metal-to-metal contact. A sudden increase in the friction coefficient is the evidence of that the tribofilm formed by standard additives present in 15W-50 engine oil is not stable on aluminum surfaces.

To the contrary, novel hf-BILs according to the invention exhibit a different trend compared to than in the 15W-50 engine oil. In the case of P66614-BMB and P66614-BMLB, there was no increase in the friction coefficient over the whole period of the tribological test. The friction coefficients increased (for P66614-BScB and P66614-BOB) in the very beginning of the test, but then they stabilized after a sliding distance of 50 m. Thus, stable tribofilms (at least until 1000 m sliding distances) are formed at aluminum surfaces lubricated with novel hf-BILs already after a short sliding distance.

Stability Studies

The tetraalkylphosphonium-orthoborate according to the invention based on phosphonium cations containing only P—C bonds are considerably more stable to hydrolysis compared for instance to compounds comprising P—N bonds. We have proven experimentally the hydrolytic stability of our novel hf-BILs. A small droplet of $[P_{6,6,6,14}]$ [BScB] was put in distilled water and left inside water for 10 days to confirm the hydrolytic stability of these hf-BILs. There was no change in appearance. The sample was analysed by ESI-MS; peaks at m/z 483.5 and m/z 283.0 for $[C_{32}H_{68}P]^+$ and $[C_{14}H_8O_6B]^-$, respectively, and the absence of other peaks in ESI-MS spectra confirmed the hydrolytic stability of these hf-BILs.

The invention claimed is:

1. A lubricant component, wherein it comprises:

a) at least one anion selected from the group consisting of a mandelato borate anion, a malonato borate anion, a succinato borate anion, a glutarato borate anion and an adipato borate anion, and b) at least one cation selected from the group consisting of a tetraalkylphosphonium cation, a choline cation, an imidazolium cation, a borronium cation and a pyrrolidinium cation, wherein said at least one cation has at least one alkyl group substituent with the general formula $C_nH_{2n+1}$, wherein $1 \leq n \leq 80$.

2. The lubricant component according to claim 1, wherein $1 \leq n \leq 60$.

3. The lubricant component according to claim 1, wherein the anion is selected from the group consisting of a bis (mandelato)borate anion and a bis(malonato)borate anion, and wherein the cation is a tetraalkylphosphonium cation.

4. The lubricant component according to claim 1, wherein the anion is a bis(succinato)borate anion and wherein the cation is a tetraalkylphosphonium cation.

5. The lubricant component according to claim 1, wherein the anion is selected from the group consisting of a bis (glutarato)borate anion and a bis(adipato)borate anion and wherein the cation is a tetraalkylphosphonium cation.

6. The lubricant component according to claim 1, wherein the only cation is tetraalkylphosphonium with the general formula $PR'R_3^+$, wherein R' and R are $C_nH_{2n+1}$.

7. The lubricant component according to claim 6, wherein R' is selected from the group consisting of $C_8H_{17}$ and $C_{14}H_{29}$, and wherein R is selected from the group consisting of $C_4H_9$ and $C_6H_{13}$.

8. The lubricant component according to claim 1, wherein the lubricant component comprises at least one selected from the group consisting of tributyloctylphosphonium bis (mandelato)borate; tributyltetradecylphosphonium bis(mandelato)borate; trihexyltetradecylphosphonium bis(mandelato)borate, tributyltetradecylphosphonium bis(malonato) borate, trihexyltetradecylphosphonium bis(malonato)borate, tributyltetradecylphosphonium bis(succinato)borate, trihexyltetradecylphosphonium bis(succinato)borate, tributyltetradecylphosphonium bis(glutarato)borate, trihexyltetradecylphosphonium bis(glutarato)borate, tributyltetradecylphosphonium bis(adipato)borate, trihexyltetradecylphosphonium bis(adipato)borate, N-ethyl-N-methylpyrrolidinium bis(mandelato)borate, 1-ethyl-2,3-dimethylimidazolium bis(mandelato)borate, 1 methylimidazole-trimethylamine-$BH_2$ bis(mandelato)borate, 1,2-dimethylimidazole-trimethylamine-$BH_2$ bis(mandelato)borate.

9. The lubricant component according to claim 1, wherein the lubricant component comprises trihexyltetradecylphosphonium bis(mandelato)borate.

10. The lubricant component according to claim 1, wherein the lubricant component comprises trihexyltetradecylphosphonium bis(malonato)borate.

11. A lubricant comprising 0.05-100 wt % of the lubricant component according to claim 1.

12. The lubricant according to claim 11, wherein the lubricant comprises 0.05-20 wt %, of the lubricant component.

13. The lubricant according to claim 11, wherein the lubricant comprises 0.1-5 wt %, of the lubricant component.

14. The lubricant according to claim 11, wherein the lubricant comprises 0.5-5 wt %, of the lubricant component.

15. A method for reducing wear and reducing friction comprising use of a lubricant with the lubricant component according to claim 1 as a neat lubricant and as an additive to other lubricants.

16. A method for reducing friction comprising use of a lubricant with the lubricant component according to claim 1 as a neat lubricant and as an additive to other lubricants.

17. A method for reducing wear comprising use of a lubricant with the lubricant component according to claim 1 as a neat lubricant and as an additive to other lubricants.

* * * * *